United States Patent [19]
Ingram et al.
[11] 4,232,729
[45] Nov. 11, 1980

[54] AIR-COOLED HEAT EXCHANGER FOR COOLING INDUSTRIAL LIQUIDS

[75] Inventors: Jocely P. Ingram, Sasolburg, South Africa; Harry Kassat, Bochum; Herbert Kolenda, Witten-Herbede, both of Fed. Rep. of Germany

[73] Assignees: South African Coal, Oil & Gas Corp., Limited, Johannesburg, South Africa; Gea Luftkuehlergesellschaft Happel GmbH & Co., Bochum, Fed. Rep. of Germany

[21] Appl. No.: 911,704

[22] Filed: Jun. 1, 1978

[51] Int. Cl.[3] ..... F28F 27/00
[52] U.S. Cl. ..... 165/39; 165/DIG. 1; 165/95; 165/122; 165/172
[58] Field of Search ..... 165/DIG. 1, 71, 95, 165/122, 172, 39, 111, 113; 15/104.03

[56] References Cited

U.S. PATENT DOCUMENTS

| | | | |
|---|---|---|---|
| 1,068,094 | 7/1913 | Bailey et al. | 237/12.3 A |
| 1,603,960 | 10/1926 | Lewis | 165/122 |
| 1,758,643 | 5/1930 | Baetz | 165/122 |
| 1,849,946 | 3/1932 | Modine | 165/122 |
| 2,038,912 | 4/1936 | Summers | 165/172 |
| 2,401,918 | 6/1946 | Elder et al. | 165/122 |
| 2,518,760 | 8/1950 | Dieter | 165/122 |
| 3,305,011 | 2/1967 | Smith | 165/172 |
| 3,759,317 | 9/1973 | Van Diepenbroek | 165/122 |
| 3,768,546 | 10/1973 | Shipes | 165/DIG. 1 |
| 3,887,002 | 6/1975 | Schoonmann | 165/113 |

FOREIGN PATENT DOCUMENTS

| | | | |
|---|---|---|---|
| 1501614 | 11/1971 | Fed. Rep. of Germany | 165/172 |
| 567931 | 3/1973 | U.S.S.R. | 165/172 |

*Primary Examiner*—Albert W. Davis
*Assistant Examiner*—Margaret A. Focarino
*Attorney, Agent, or Firm*—Michael J. Striker

[57] ABSTRACT

An air-cooled heat exchanger for cooling industrial liquids, particularly such which have a tendency to form deposits at least when the temperature thereof drops below a given level, includes a plurality of externally ribbed hollow cooling sections which are arranged in a plurality of parallel rows each including a multitude of the cooling sections, and a plurality of connecting sections which so communicate the cooling sections with one another as to form at least two separate sets of interconnected sections the cooling sections of which alternate with one another in each of the rows. The sections are so interconnected that the liquid to be cooled will flow through each of the sets in each of the rows and between the rows in a meandering path and in a mutual cross-countercurrent with respect to the flow of cooling air which is advanced by a blower transversely of and past the cooling sections. The throughput rate of the blower may be controlled in dependence on the exit temperature of the cooled liquid. The connecting sections are preferably curved tubular elements the radius of curvature of which corresponds to one-half of the spacing between the two cooling sections of the same set within the respective row. The rows may be spaced apart a greater distance than that between the individual cooling sections of each of the rows.

20 Claims, 8 Drawing Figures

AIR-COOLED HEAT EXCHANGER FOR COOLING INDUSTRIAL LIQUIDS

BACKGROUND OF THE INVENTION

The present invention relates to a heat exchanger for cooling industrial liquids in general, and more particularly to an air-cooled heat exchanger for liquids which have a tendency to form deposits at least when the temperature thereof drops below a given level.

Air-cooled heat exchangers are already known and in widespread use. In industrial applications, that is, for cooling the above-mentioned industrial liquids, these heat exchangers include at least one bunch of cooling pipes which are provided with external ribs or fins thereon and past which cooling air is being advanced to withdraw heat from the cooling tubes and the fins thereof. More often than not, the cooling sections of these conventional heat exchangers have their externally ribbed cooling tubes arranged horizontally, parallel to one another, and in rows next to each other or in columns above each other. The liquid to be cooled is then introduced into the individual cooling sections and withdrawn therefrom after passing through the same.

A considerable problem exists when industrial liquids, which usually include particulate material and/or components which have a tendency to precipitate or deposit when the temperature of the liquid drops below a given level, are to be cooled, which resides in the fact that the interiors of the cooling sections may become clogged by the deposition and by the subsequent adherence of the particulate material or of the precipitated components, and that the cooling process is rendered ineffective or is interrupted altogether as a result of this.

This problem exists, for instance, but not exclusively, when tar-containing water obtained during the gasification of coal is to be cooled, which tar-containing water may, under certain circumstances, include considerable amounts of particulate materials in the form of coal dust or fly ash. Only when it can be assured that no particulate material will deposit at any region of the cooling system within the respective tubes, but that the particulate material will rather be kept in a suspension, is it possible to avoid the clogging of the heat exchanger. On the other hand, when the velocity of flow of the liquid to be cooled is too high, for instance, in an attempt to prevent the particulate material from depositing, there comes into existence another disadvantage that the particles which are entrained in and transported by the liquid to be cooled subject the sections of the cooling system to a substantial wear due to erosion, especially in the regions of the heat exchangers where the direction of flow of the liquid changes. Finally, this situation is further aggravated when the liquid to be cooled is tar-containing water by the fact that the temperature of the tar-containing water during the cooling thereof must not drop below a critical temperature, inasmuch as tar would precipitate from the water when this limiting temperature is reached and deposit within the cooling sections of the heat exchanger on the surfaces which bound the path of flow of the tar-containing water therethrough. This, in turn, brings about not only the danger that these tar deposits would reduce the flow-through cross-sectional area of the respective tubular sections possibly up to eventually full obstruction thereof, but also a reduction of the heat transmission or heat transportation as a result of the heat-insulating properties of these deposits so that the cooling effect of the heat exchanger will drop below that for which the heat exchanger has been designed. Even this latter problem is not exclusively encountered in the heat exchangers for cooling tar-containing water; rather, it occurs in a similar manner even in connection with cooling numerous other industrial liquids.

The drawbacks which have been discussed above with respect to the cooling of industrial liquids and which are detrimentally reflected in the cooling efficiency and cooling operation of the heat exchanger, are naturally the more important the larger the heat exchanger is to be made in order to be able to handle the volume of the liquid to be cooled, and, as a consequence thereof, the more complex the heat exchanger is to be constructed.

In order not to have to construct the heat exchanger, even with respect to the number of individual cooling branches provided therein for the liquid too complex and, possibly even more importantly, in order to be able to use cooling tubes having relatively large diameters of, for instance, 50 millimeters or more, it has already been proposed to cool the above-mentioned liquids by means of water. While it is true that the relatively large-diameter cooling tubes have the advantage that they are relatively easy to internally cleanse from time to time, an important disadvantage of this water-cooled heat-exchange system is that, precisely because of the cooling of the cooling tubes by cooling water, it is very difficult to cleanse the cooling tubes during the operation of the heat exchanger. For the latter reason, it is usually necessary in order to be able to cool the industrial liquid without interruption and to be still able to periodically internally cleanse the cooling tubes, to provide two separate heat exchangers in tandem so that the cooling tubes of one of these heat exchangers can be cleansed while the other heat exchanger cools the liquid flowing therethrough, and vice versa following the termination of the cleansing operation of the first-mentioned heat exchanger. On top of this, there is encountered the disadvantage that, for instance, when the liquid to be cooled is tar-containing water, high temperatures of the cooling tubes occur at the side of the cooling water because of the high entrance temperatures of the liquid to be cooled which are in the order of magnitude of approximately 170° C., so that the danger of corrosion and of formation of deposits at the cooling water side of the cooling tubes is very pronounced. To avoid these consequences alone, very often the cooling tubes have to be made of relatively expensive alloyed steel and/or the cooling water must be circulated in a closed circuit for the cooling water to be re-cooled therein, in order to be able to perform the actual cooling operation with treated, fully desalted water.

The latter expedient would also be unavoidable under the circumstances where either the cooling water is not available in sufficient quantities or where the cooling water is too expensive because of the difficulties arising during the acquisition thereof.

Because the above-mentioned difficulties, the cooling even of industrial liquids by an air stream propelled by a blower presents itself as a desirable alternative. A particular advantage of this is that the cooling air is available in practically unlimited quantities anywhere inasmuch as it can be withdrawn from the ambient atmosphere and then blown against the cooling tubes. In view of the fact that the heat-transmission coefficient at the side of the liquid to be cooled is up to fifty times greater than on the side of the cooling air, it is mandatory under these circumstances to equip the heat exchanger with cooling tubes which are provided with external ribs or fins. When the cooling tubes are provided with the external ribs, the cooling surface which presents itself to the cooling air increases up to thirty times relative to the exposed surface of a simple circular cooling tube.

However, externally ribbed cooling tubes which are optimally usable and economical to manufacture are limited as to their inner diameter to a predetermined value which, in general, lies only between 25 and 38 millimeters. If the inner diameter of the cooling tubes were greater, the heat-transmission coefficients which determine the penetration of heat through the cooling tubes would be too low and thus the heat exchanger would be too expensive because of the increased cooling surface thereof. In this connection, it is to be considered that extremely high amounts of the liquid to be cooled, for instance, of tar-containing water, are encountered in industrial plants, such as those for coal gasification. This renders it often necessary to arrange up to three thousand cooling tubes or more which have lengths up to 12 meters in a cooling unit of the air-cooled heat-exchanger type.

Experience has shown that air-cooled heat exchangers of these dimensions cannot be so arranged, based on the current state of the art, that a faultless cooling operation can be assured under all conditions and while satisfying all of the above-enumerated requirements.

Namely, this would presuppose that the liquid to be cooled have always the same, sufficiently high, but not too high, flow velocity at all regions of the exchanger in order to avoid the possibility of deposition of and clogging by particles which are entrained in the liquid being cooled. In addition thereof, it would be required to so select the flow velocity of the liquid as to avoid or at least reduce possible erosions, especially at those regions of the heat exchanger where the direction of flow of the liquid being cooled changes. Moreover, it would be necessary to assure during the cooling operation that the liquid being cooled does not suffer a reduction in its temperature below the given critical limiting temperature at any region of the heat exchanger, in order to avoid the precipitation from the solution of such components which tend to precipitate at or below the limiting temperature, such as, for instance, tar out of tar-containing water. Finally, it would also be necessary, for instance, when the tar-containing water is the liquid to be cooled, to so coordinate the various temperatures which occur within the cooling system, that is, the inlet temperature of the liquid to be cooled which lies within rather narrow limits about, for instance, 170° C., the exit temperature of the cooled liquid which amounts to, for instance, approximately 70° C., the critical temperature which is, for instance, 60° C. and at which tar would precipitate from the tar-containing water, as well as the temperature of the cooling air at the particular location of the heat exchanger which may be, for instance, at about 30° C. in average and may drop, for instance, to as low as −5° C., during the design of the heat exchanger, that an unproblematical cooling operation of the heat exchanger is obtained even when the conditions change, for example, when the temperature of the ambient air changes.

The satisfaction of all of these conditions is, for a variety of reasons, not possible or possible only after overcoming considerable difficulties, in the conventional air-cooled heat exchangers. In view of the fact that, in the conventional air-cooled heat exchangers of this type, the bunches of externally ribbed cooling tubes are so put together that the externally ribbed cooling tubes are welded or rolled at their ends in end plates which, at their sides which face away from the cooling tubes, are provided with distributing or collecting chambers which are either welded or detachably connected to the respective end plates, it is impossible for this reason alone to obtain a uniformly high flow velocity of the liquid throughout the system in installations using huge bundles of externally ribbed cooling tubes numbering up to fifty of such cooling tubes which are arranged next to one another and which are arranged at least partially in parallelism with one another with respect to the above-mentioned end chambers. This is attributable to the fact that, in dependence on the number of the cooling tubes which are arranged in parallel because of the configurations of the chambers or any partitions of the latter, the flow velocity of the liquid within the chambers drops considerably with respect to that obtained within the cooling tubes, which results, in time, in the formation of deposits and in clogging at least in the above-mentioned chambers.

A further disadvantage of the prior-art air-cooled heat exchangers for the purpose here under consideration resides in the fact that different temperatures of the liquid being cooled are obtained in the direction of the flow of the cooling air within the individual rows of the cooling tubes of the respective bundle of such tubes. Namely, in that row of the cooling tubes which is closest to the point of origin of the inflowing cooling air, a correspondingly higher cooling effect is obtained naturally. On the other hand, inasmuch as already preheated cooling air comes into contact with the cooling elements of the rows which are located downstream of the first-mentioned row in the direction of flow of the cooling air, these following rows of cooling tubes will be cooled less and less, the cooling effect being least pronounced at the row of the cooling elements which is arranged last as considered in the flow of direction of the cooling air. It follows from the above that a mixing takes place in the collecting chamber or chambers in which the externally ribbed cooling tubes open at their ends between the amounts of liquid which have been cooled to a greater or lesser degree, respectively. Thus, the temperature of the cooled liquid which can be measured at the outlet nipple of the bundle after the termination of the cooling process is an average temperature which results from the mixing of the branch streams of the cooled liquid which have respectively different temperatures.

Now, when the exit temperature of the cooling air is measured downstream of the bundle of the externally ribbed cooling tubes following the heat exchange therewith it will be established that the cooling air is heated up less with increasing cooling of the flowing liquid being cooled. This is attributable to the fact that, as the temperature differential between the cooling air and the liquid being cooled decreases in correspondence to the progress of the cooling process, less and less heat is carried out of the individual parts of the heat exchanger and, consequently, the cooling air which passes therethrough is also correspondingly heated up to a lesser extent. The danger that, for this reason, the liquid could be undercooled when the ambient temperature of the cooling air decreases, is particularly great in this situation. Therefore, the externally ribbed cooling tube bundles as they are usually used for the cooling of liquids, are not utilizable for the above-mentioned purposes wherein a local undercooling of the liquid is to be avoided under all circumstances.

SUMMARY OF THE INVENTION

Accordingly, it is a general object of the present invention to avoid the disadvantage of the prior art.

More particularly, it is an object of the present invention to develop an air-cooled heat exchanger for cooling industrial fluids which avoids the above-enumerated disadvantages of the prior-art heat exchangers of this type.

A further object of the present invention is to provide an exchanger of the type here under consideration which renders it possible to achieve a uniform flow of the liquid to be cooled through the heat exchanger.

It is still another object of the present invention to so construct the heat exchanger as to assure that the temperature of the liquid being cooled is maintained within predetermined limits throughout the heat exchanger, and especially that the temperature of the liquid does not fall under a critical temperature at which components of the liquid being cooled would precipitate from the liquid.

A concomitant object of the present invention is to design a heat exchanger which, while satisfying the above-mentioned requirements, is simple in construction, inexpensive to manufacture and particularly reliable in operation.

A further object of the present invention is to provide a heat exchanger which can be easily cleansed of deposits from the liquid being cooled even during the operation of the heat exchanger.

In pursuance of these objects and others which will become apparent hereafter, one feature of the present invention resides in a heat exchanger for cooling industrial liquids, particularly such which have a tendency to form deposits at least when the temperature thereof drops below a given level, which, briefly stated, comprises a plurality of elongated hollow cooling sections which are parallel to and spaced from one another and have inlet and outlet ends respectively arranged next to each other; a plurality of connecting sections each of which so communicates said outlet end of one of said cooling sections with said inlet end of another of said cooling sections that said sections together define at least one meandering path; means for passing the liquid to be cooled in said meandering path through said section for the liquid to transfer a part of its heat content at least to said cooling sections; and means for advancing a cooling gas in a predetermined direction past and in contact at least with said cooling sections for the cooling gas to cool the latter. Advantageously, the advancing means includes at least one blower which communicates with the ambient atmosphere to draw cooling air therefrom and to discharge the heated cooling air back into the ambient atmosphere. Preferably, at least the cooling sections have external ribs thereon which improve the heat transfer between the liquid being cooled and the cooling air through the cooling sections. The cooling sections may extend either substantially horizontally or substantially vertically.

According to a currently preferred aspect of the present invention, the cooling sections are arranged in at least one row which preferably extends along a plane transverse to the above-mentioned direction. However, the cooling sections are preferably arranged in more than one row, all of the rows being similar to each other and being spaced from each other in the above-mentioned direction.

According to a further currently preferred aspect of the present invention, some of the above-mentioned connecting sections communicate the inlet and outlet ends of only some of the cooling sections to form a set of interconnected sections. Then, the remaining connecting sections so communicate said inlet and outlet ends of the remaining cooling sections that the remaining sections together form at least one additional set of interconnected sections which defines an additional meandering path. When the heat exchanger is constructed in the above-mentioned manner, the passing means includes means for individually introducing the liquid into and withdrawing the same from each of the meandering paths.

In this environment, it is particularly advantageous, as proposed by the present invention, for the cooling sections of the above-mentioned sets to alternate with one another within each of the rows in a periodically repeating succession the period of repetition of which is determined by the number of the sets. Then, it is particularly advantageous when the connecting sections so communicate the cooling sections within each of the sets that the liquid flows in each of the above-mentioned rows and between the rows in constantly changing directions and in a mutual cross-countercurrent with the cooling gas.

The construction of the heat exchanger in the above-mentioned manner, it is possible not only to achieve a uniform flow velocity of the liquid being cooled throughout the heat exchanger and to avoid the formation of dead corners or the like in which deposition would take place, even when the volume of the liquid to be cooled is quite large, but also to achieve, as a result of the communication of the sections with one another, in accordance with the present invention, that the externally ribbed cooling sections or the rows thereof which are arranged downstream of one another as considered in the direction of flow of the cooling air are not subjected to any undesirable undercooling.

As a result of the fact that the otherwise customary end distributing or collecting chambers have been avoided, and that the externally ribbed cooling tubes or sections which belong to the same set are connected with one another by the connecting sections within each of the rows as well as between the rows which are arranged above one another in the vertical direction, in such a manner as to define the meandering path of the respective set, as well as the fact that the sections of the tubes which are individually connected to the passing means for the liquid to be cooled are arranged in a periodically alternating succession the periodicity of alternation of which is determined by the number of the different sets, it is possible to cool even a huge volume of the liquid in an extremely uniform manner and at a minimum possible area of the cooling surfaces. The liquid being cooled flows through the cooling sections of each group, which are separately supplied with the liquid to be cooled, first through the associated cooling sections of the upper row of cooling sections which are connected with one another via the above-mentioned connecting sections, whereupon the partially cooled liquid is conducted from the respectively last cooling section of each set of the uppermost row of cooling sections to the cooling section of the row of cooling sections which is located immediately below the uppermost row, whereupon the liquid being cooled is accordingly conducted in countercurrent to the flow of the liquid in the row of cooling sections which is located upwardly thereof. On the other hand, the cooling air contacts the cooling sections of the lowermost row of cooling sections, through which the already partially cooled liquid flows, and only then the cooling air will be able to reach the row or rows of the cooling sections which are arranged upwardly of the lowermost row of cooling sections. As a result of this, the cooling air and the liquid being cooled always flow in mutual cross-countercurrent with respect to one another. The direct series communication of the externally ribbed cooling sections within the sets, wherein the cooling sections which belong to the different sets alternate with one another in a periodical succession the periodicity of which depends on the number of the various sets, has a further important advantage, particularly when the connecting sections are arcuate tubular elements, that the tubular arcuate elements which respectively communicate those of the cooling sections which belong to the same set of cooling sections can have a relatively large radius of curvature. So, for instance, when two of the abovementioned sections which are connected with one another to define the above-mentioned meandering paths are provided, the radius of curvature of the arcuate tubular elements may approximate the distance between two of the cooling sections within each of the rows and thus may be twice larger than otherwise necessary if the end portions of the immediately adjacently located cooling sections were to be connected by the arcuate tubular elements. As a result of this substantially increased radius of curvature which, in any event, amounts of more than 50 millimeters, it is possible to substantially eliminate the erosion phenomena and the wear which results therefrom. These conditions are even more advantageous when not only two but three or four of the above-mentioned sets of sections are arranged within each bunch or plurality of the sections, each of the sets again being interconnected in the above-discussed meandering manner and each being spearately or individually supplied with the liquid to be cooled. Under these circumstances, the connecting sections skip not one, but rather two or three of the end portions of the cooling sections which are located between the end portions of the cooling sections of the same set which are to be connected. Thus, the radius of curvature of each of the arcuate tubular sections or elements may be even greater, generally corresponding to one-half of the number of the various sets times the distance between the immediately adjacent cooling sections. In order to avoid the mutual interference of the arcuate tubular connectors or connecting sections with one another, it is proposed in accordance with a currently preferred further development of the present invention to oppositely bend the connecting sections of the sets which overlap one another in space relative to the horizontal plane so that the connecting sections bypass each other at their region of overlap and still are able to communicate the associated ones of the cooling sections of the respective set which alternate with the cooling sections of the other set or other sets, in the above-mentioned meandering manner. In all instances, the connecting sections which communicate the cooling sections of the same set within each row are laterally, that is, horizontally, offset with one another relative to the respective connecting sections which communicate the cooling sections of the respectively neighboring set, by a distance which corresponding to at least the distance between the cooling sections within the respective row, or to a multiple of this distance, these connecting sections again overlapping each other in space.

Advantageously, the connecting sections which communicate those of the cooling sections of the respective set in the above-mentioned meandering fashion within the respective bundle or plurality of the sections, have a radius of curvature which exceeds the lateral distance between the cooling sections arranged in any of the respective rows. Usually, this can be achieved merely by offsetting the cooling elements of the two superimposed rows of the cooling elements laterally with respect to one another, for instance, by a distance which approximately corresponds to one-half of the distance between the cooling sections of each of the rows. However, in many instances, it is necessary or advisable to also make the vertical distance between the immediately superimposed rows of the cooling element greater than the lateral distance between the individual adjacent cooling tubes of each of the rows.

Preferably, each of the individual rows of cooling sections of the bundle has the same number of the cooling sections belonging to the different sets of the cooling sections which are individually communicated with the liquid to be cooled. It is particularly advantageous when at least four superimposed rows of the externally ribbed cooling sections of the different sets are arranged in each bundle.

In the interest of a possibly uniform cooling of all of the cooling sections of each bundle which are arranged in the different rows above one another, it is further advantageous according to a further important feature of the present invention that the liquid-outlet nipples which are associated with the various groups and which are arranged immediately next to one another are provided at the lowermost row of the cooling sections and are downwardly spaced from the respectively associated liquid-inlet nipples which are situated at the uppermost row of the cooling sections. Experience has shown that, when the nipples are arranged in the above manner, the total heating up of the cooling air, as measured downstream of the bundle of cooling tubes is approximately the same at each region of the cooling air stream. When this is related to the configuration of the cooling unit with the same exposed surface, this means that approximately the same amount of heat is withdrawn in each of the cooling units and local undercoolings are in any event avoided in this manner. Even though other patterns would also be conceivable, it has been established as being advantageous and, hence, it is currently preferred, to connect the different sets of the cooling sections within each bundle in parallelism with one another with respect to the flow of liquid being cooled therethrough. The number of the sets of the cooling sections which are supplied with the liquid to be cooled in parallel with one another and which communicate with one another in the above-mentioned meandering manner, depends predominantly on the volume of the liquid to be cooled per unit of time. Under certain circumstances, it may be necessary or advantageous to combine a plurality of bundles of the externally ribbed cooling tubes into a single cooling or heat-exchanger unit. As a result of the fact that the present invention provides the possibility to combine a plurality of the bundles of the cooling tubes in a single cooling or heat-exchanger unit, and that each of the bundles can be provided, in accordance with the present invention, with two or more sets of the cooling sections which are separately supplied with the liquid to be cooled and which are connected with one another in the above-mentioned manner, the whole system is extraordinarily variable and thus very flexible and can therefore be accommodated to the various requirements or conditions so as to be universally utilizable.

It is also possible, as a result of the arrangement and interconnection of the externally ribbed cooling sections within the individual bundles and their contacting with the stream of the cooling air in the manner proposed by the present invention, to let the cooling of the liquid in the multiple cross-countercurrent proceed in a manner which can be controlled at all times. Inasmuch as the cooled exiting liquid is in contact with the cold incoming cooling air, an exact temperature control can be achieved by controlling the parameters of the cooling air.

In order to avoid an undercooling of the liquid during the cold period of the year or during the night hours, a signal indicative of the exiting temperature of the liquid can be used to correspondingly control the amount of air which is being passed by the cooling sections. So, for instance, when the blower is provided with blades which can be adjusted as to their positions during the operation of the blower either in a pneumatic or in an electric manner, it is possible to continuously accommodate the amount of the cooling air to the particular requirements in dependence on the predetermined exiting temperature of the liquid which is to be maintained constant.

A reliable control of the arrangement when the ambient temperature varies can be further improved, or such a control can be obtained in the first instance in the absence of the adjustability of the blades of the blower, and the amount of the air which contacts the externally ribbed cooling sections of the bundle from the outside can be determined, by the throttling action of positionally adjustable louvers arranged upstream or downstream of the blower, which are controlled in dependence on the exiting temperature of the cooled liquid which is determined, for instance, by means of thermostats or the like.

Furthermore, it is also advantageous to provide the connecting sections which communicate the individual cooling sections of the same set of cooling sections with one another with closable cleaning nipples. Then, it is possible to pass flexible wires with brushes connected thereto through these cleaning nipples and to introduce the same into the individual cooling sections. However, these cleaning nipples can serve, additionally or instead, to perform internal flushing of the cooling sections with solvents, or to pass a high-temperature steam therethrough and through the cooling sections to be cleaned. The subdivision of the bundles of the externally ribbed cooling sections into a plurality of sets of the cooling sections which are individually supplied with the liquid to be cooled, renders it possible to cleanse the individual cooling pipes of one of the sets even during the operation of the heat exchanger. To accomplish this, it is merely necessary to interrupt the communication of the meandering set the cooling sections of which are to be cleaned, with the liquid by interposed conventional closing valves, for the duration of the cleaning operation.

Even though the horizontal orientation of the cooling sections of the bundle represents the alternative which is preferred for practical reasons especially in large installations, it is also within the scope of the invention and proposed thereby to so arrange the heat exchanger in a position which is rotated through 90° that the longitudinal axes of the externally ribbed cooling sections are arranged vertically and that the stream of the cooling air passes through the heat exchanger in the horizontal direction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
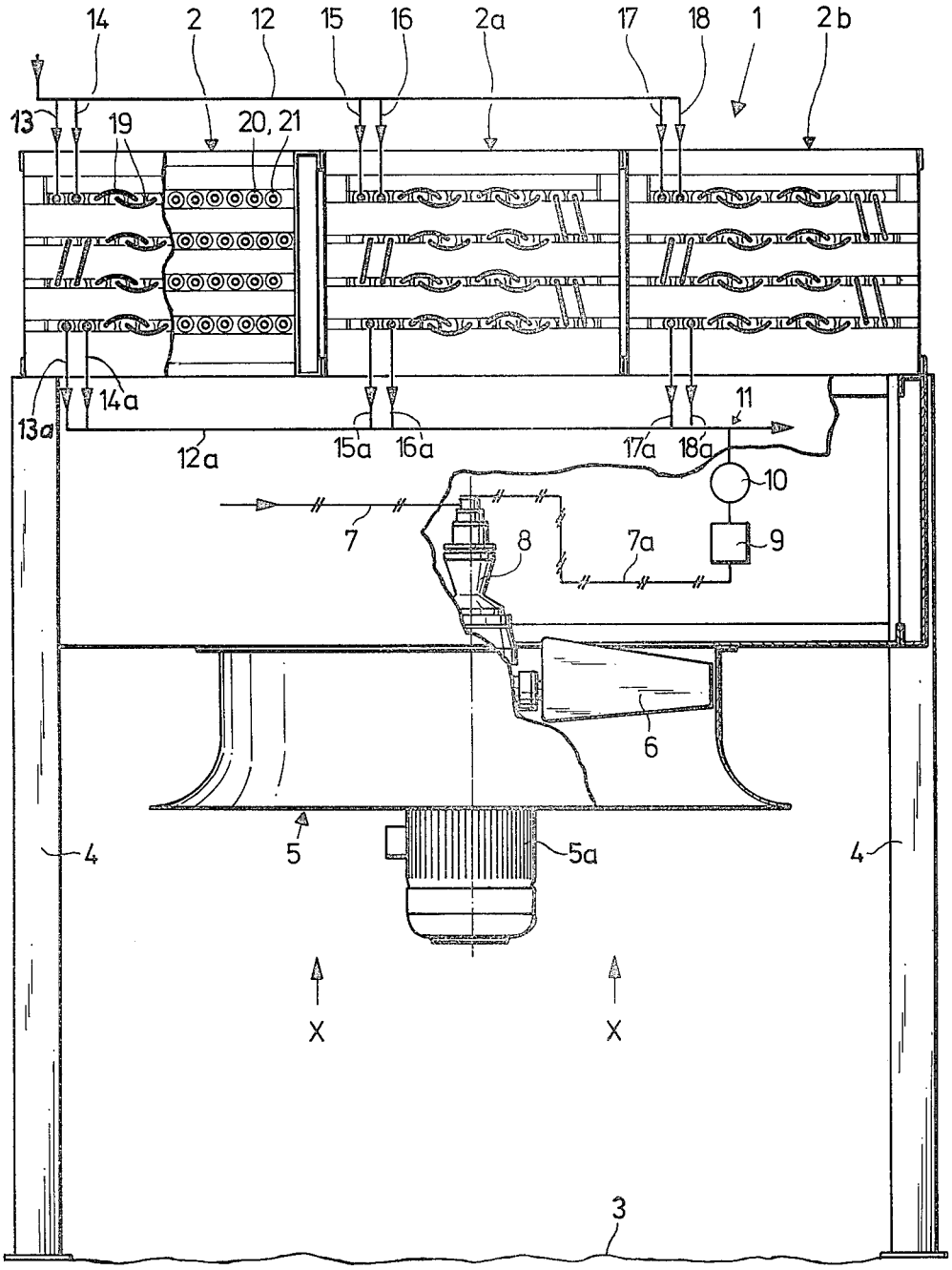
FIG. 1 is a partly sectioned somewhat diagrammatic side elevational view of a heat exchanger in accordance with the invention which includes three heat exchanger units.

Referring now to the drawing in detail, and first to FIG. 1 thereof, it may be seen therein that the reference numeral 1 has been used to designate a heat exchanger or cooler of the present invention in toto. The heat exchanger 1 includes three structurally separate but interconnected heat exchanger units 2, 2*a* and 2*b* respectively which are supported a considerable distance away from a floor or foundation 3 by means of a support construction which includes profiled support beams 4.

The support beams simultaneously serve to support a blower 5 or a plurality of such blowers 5, the blower being driven in rotation by an electromotor 5*a* and having blades which draw the ambient air in the direction of the arrows x and propel the same from below against the heat exchanger units 2, 2*a* and 2*b*.

The reference numeral 7 indicates a pressurized air conduit which communicates with a pneumatically energized adjusting arrangement 8 which is operative for changing the angle of attack of the blades 6 of the blower 5. Advantageously, the adjusting arrangement 8 is constructed as a pneumatic cylinder-and-piston unit. The reference numeral 7*a* indicates a further conduit for the pressurized air which communicates with the output side of a regulator 9, the input side of the regulator 9 being connected with and supplied with signals from a temperature measuring instrument 10. The temperature-measuring instrument 10 is of a conventional construction and may include, for instance, a thermostat by means of which the temperature at an exit location 11 is being measured.

Now, should the exit temperature of the cooled liquid at the location 11 be too high, the signal from the temperature-measuring instrument 10 will so influence the operation of the regulator 9, which also is of a conventional construction, that the latter will energize the adjusting arrangement 8 in such a sense that the angle of attack of the blades 6 of the blower 5 will increase and in this manner the amount of air passing through the blower 5 per unit of time will also be increased. On the other hand, if the exit temperature of the cooled liquid which is being measured at the location 11 is too low so that a danger of undercooling of the liquid in the heat exchanger 1 exists, the regulator 9, contrarily to what has been mentioned above, brings about a smaller angle of attack of the blades 6 of the blower 5 so that the amount of the cooling air propelled by the blower 5 will decrease accordingly.

Instead of or in addition to the above-mentioned regulation or control of the throughput of the blower 5 there can also be utilized a blower transmission which is automatically controlled in dependence on the exit temperature of the cooled liquid measured at the location 11. Similarly, it is also possible to provide adjustable louvers or baffles which are adjustable in their positions in dependence on the exit temperature of the cooled liquid, which may be arranged upstream or downstream of the blower 5, and which are of a conventional construction and operation so that they have not been illustrated in the drawings in order not to unduly encumber the same.

As may also be ascertained from FIG. 1, each of the heat exchange units 2, 2*a* and 2*b* in this exemplary embodiment of the invention consist of four rows of horizontally oriented cooling tubes or sections 20 which are provided with external ribs or fins 21, the rows being arranged one above the other and each including twelve of the externally ribbed cooling sections 20 which are arranged adjacent one another in the horizontal direction.

Having so discussed the construction of the heat exchanger 1, the flow pattern of the cooling air and of the liquid being cooled therethrough will now be discussed based on FIGS. 2 and 3 considered in conjunction with the structure of FIG. 1. The reference numeral 12 indicates a distributing conduit for the liquid to be cooled, while the reference numeral 12*a* indicates a collecting conduit for the liquid which has already been cooled in the heat exchanger 1. Altogether, six separate conduits 13–18 branch off from the distributing conduit 12 in parallelism with one another, of which the branch conduits 13 and 14 communicate with the first heat exchanger unit 2, the branch conduits 15 and 16 with the second heat exchanger unit 2*a* and the branch conduits 17 and 18 with the third heat exchanger unit 2*b*. At the exit or outlet side of the heat exchanger units 2, 2*a* and 2*b*, there are provided corresponding branch conduits 13*a*–18*a* which communicate with the collecting conduit 12*a* and of which the branch conduits 13*a* and 14*a* again communicate with the heat exchanger unit 2, branch conduits 15*a* and 16*a* with the heat exchanger unit 2*a*, and branch conduits 17*a* and 18*a* with the heat exchanger unit 2*b*.

Figure 2:
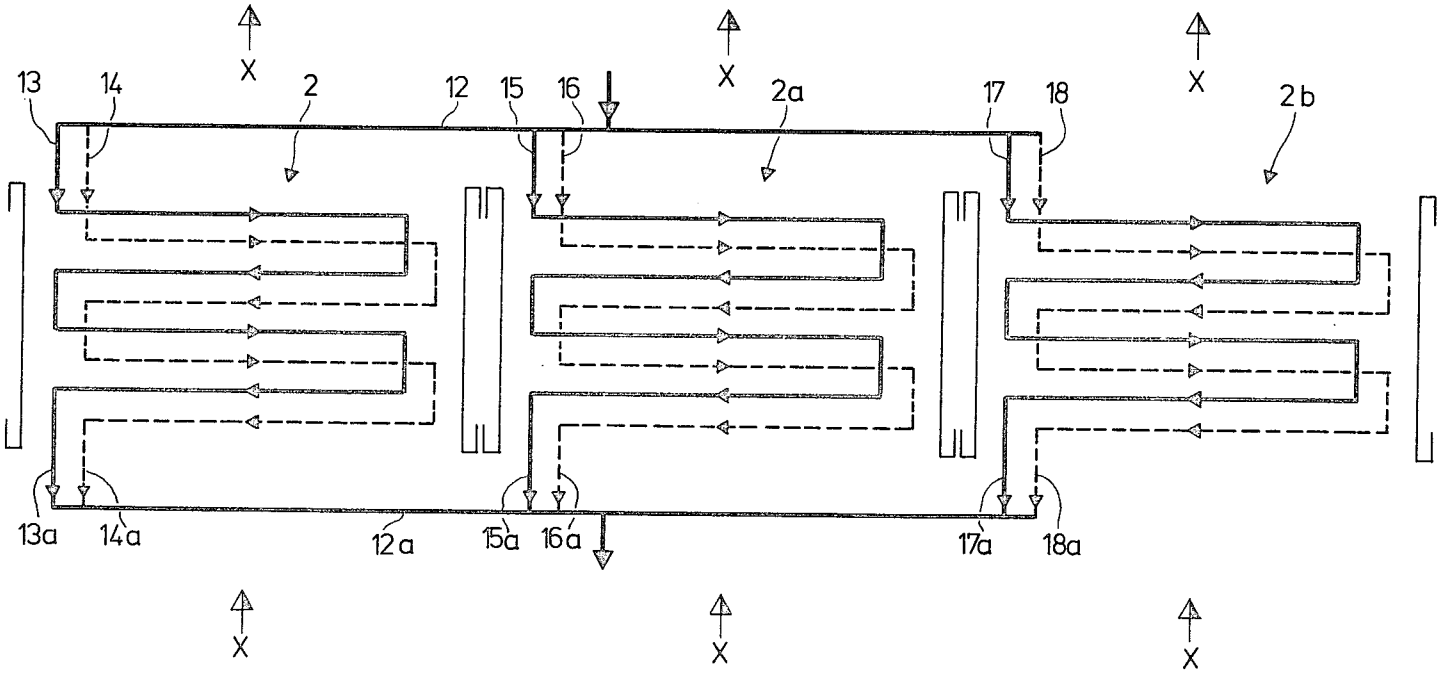
FIG. 2 is a flow diagram illustrating how the liquid being cooled flows through the three heat exchanger units of the cooling arrangement of FIG. 1.

FIG. 2 illustrates the generalized flow diagram of the liquid being cooled through the heat exchanger units 2, 2*a* and 2*b*. As may be seen in more detail in this Figure, the branch conduits 13 and 14, or 15 and 16, or 17 and 18 which are separately and in parallel connected to the distributing conduit 12 for the liquid to be cooled, so communicate with the cooling sections 20 in the respective uppermost row of the cooling sections 20 of the three heat exchanger units 2, 2*a* and 2*b* that the liquid being cooled flows through the individual rows of the cooling sections 20 in changing directions and in a meandering pattern in accordance with the arrows illustrated in FIG. 2. It may also been seen, when comparing FIGS. 1 and 2, that the branch conduits 13*a* and 14*a* or 15*a* and 16*a* or 17*a* and 18*a* communicate with the cooling sections 20 of the lowermost row of the cooling sections 20, being respectively located underneath the associated branch conduits 13 and 14 or 15 and 16 which communicate with the cooling sections 20 of the uppermost row of the cooling sections 20. In this manner, the liquid being cooled and the cooling air propelled by the blower 5 flow in a multiple cross-countercurrent with respect to one another.

While the solid lines which, in FIG. 2, connect the branch conduits 13 and 13*a*, or 15 and 15*a*, or 17 and 17*a* indicate the flow of the liquid being cooled through one set of cooling sections of each of the heat exchanger units 2, 2*a* or 2*b*, the broken lines which connect the branch conduits 14 and 14*a*, or 18 and 18*a* indicate the flow of the liquid being cooled through a second set of the cooling sections 20.

Figure 3:
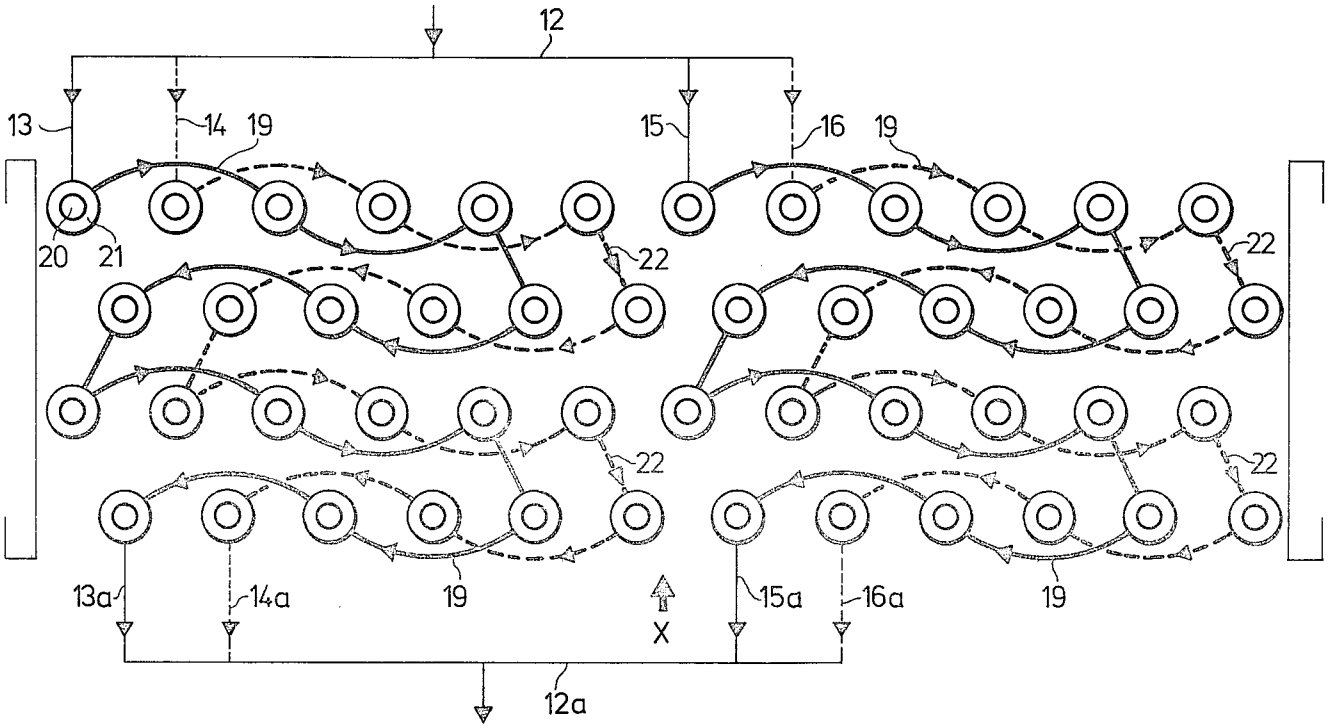
FIG. 3 is a diagrammatic view which illustrates the flow pattern of the liquid being cooled through two of the heat exchanger units of FIG. 1.

As may more clearly be ascertained from FIG. 3 when compared with FIG. 1, the cooling sections 20 of the two above-mentioned sets alternate with one another within each of the rows of the cooling sections 20, the individual cooling sections 20 of each of the sets communicating with one another via connecting sections 19. As also evident from FIG. 3, which illustrates the situation where only two different sets of the cooling sections 20 are being used, the first cooling section 20 from the left in the uppermost row of the cooling sections 20 communicates, via the associated connecting section 19, with the third cooling section 20 in the same row of the cooling sections 20 and so on, while the second cooling section 20 in the same row of the cooling sections 20, which belongs to a different set than the first and third cooling sections 20 from the left of the uppermost row of the cooling sections 20, communicates via its associated connecting section 19 with the fourth cooling section 20 from the left in the uppermost row of the cooling sections 20 and so on. In this manner, the externally ribbed cooling sections 20 which respectively belong to the same set of the cooling sections 20 are communicated with one another by the respective connecting sections 19 in the individual rows of the cooling sections 20, as well as between the four rows of the cooling sections 20 which are superimposed with one another, so that the sections 19 and 20 together define a meandering path for the liquid being cooled through the respective heat exchanger units 2, 2*a* and 2*b*. It will also be apparent from the above explanation that the individual cooling sections 20 of the two sets of the cooling sections 20 alternate with one another within each of the rows of the cooling sections 20.

Figure 4:
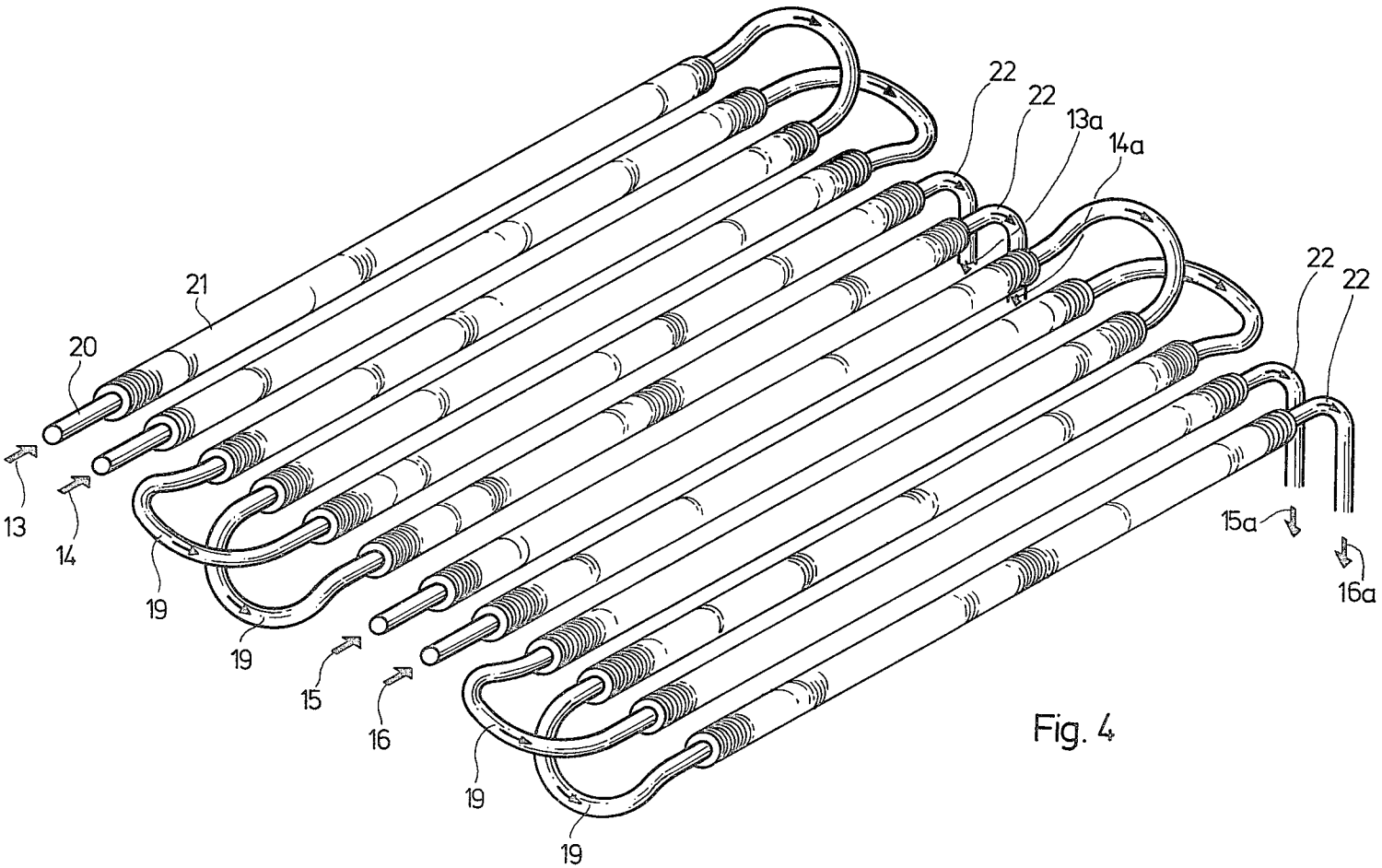
FIG. 4 is a perspective view of the uppermost row of cooling sections and connecting sections of one of the heat exchanger units of FIG. 1.

As most clearly apparent from FIG. 4 the liquid being cooled, because of the arrangement of the individual cooling sections 20 in the sets and because of the communication of the cooling sections 20 by the associated connecting sections 19 in series with one another, will flo through the sections 19 and 20 in a meandering pattern so that a more uniform cooling is obtained in the heat exchanger 1 of the present invention than in the conventional heat exchangers even for this reason.

As further ascertainable from FIG. 4, the connecting sections 19 are configurated as arcuate tubular elements which have a radius of curvature which equals or exceeds the lateral distance between two immediately adjacent ones of the cooling sections 20. The connecting sections 19 belonging to one of the sets and the connecting sections 19 belonging to the adjacent sets overlap one another and are offset with respect to each other in the plane of the respective row of the cooling sections 20 by a distance which corresponds to the spacing of the immediately adjacent ones of the cooling sections 20 from each other. As may clearly be seen when FIG. 4 is compared with FIG. 8, the connecting sections 19 are additionally so curved relative to the horizontal plane that the adjacent ones of the connecting sections 19 bypass one another in space and thus do not interfere with one another.

Going back to FIG. 3, it may be seen therein that the cooling sections 20 of the individual rows of the cooling sections 20 are offset relative to one another as between the rows by approximately one-half the distance of the cooling sections 20 of each individual row of the cooling sections 20. In this manner, even those connecting sections which have been identified with reference numerals 22 and which communicate the respectively last cooling elements 20 of a respectively upper row of the cooling elements 20 with the respectively first cooling elements 20 of the respectively lower row of the cooling elements 20 for each of the sets, can have a radius of curvature which exceeds one-half of the spacing between the individual immediately adjacent cooling sections 20 of each of the rows of the cooling sections 20. However, it is further advantageous when the vertical distance between the cooling sections 20, that is, the vertical distance between the superimposed rows of the cooling elements 20, is selected greater than the lateral distance between the individual immediately adjacent cooling elements 20 of each of the rows of the cooling elements 20, whereby the radius of curvature may be made even greater. This situation is clearly shown in FIGS. 1 and 5.

The diagrammatic illustration of FIG. 3 also differs from the structure illustrated in FIG. 1 in that the heat exchange unit illustrated in FIG. 3 has only half the number of the cooling sections 20 in each of the rows of the cooling sections 20 than each of the heat exchanger units 2, 2*a* and 2*b* of FIG. 1, that is, six instead of twelve. In this connection, it is to be mentioned that, when the connection of the distributing conduit 12 and of the collecting conduit 12*a* with the cooling section 20 of the heat exchanger units 2, 2*a* and 2*b* of an existing heat exchanger 1 is made in accordance with FIG. 3 rather than in accordance with FIG. 1, the throughput of the liquid to be cooled through the heat exchanger can be increased under certain circumstances, without sacrificing the cooling parameters for the liquid being cooled.

It is to be understood that, while the above-discussed Figures of the drawing illustrate the cooling sections 20 and their connecting sections 19 as being arranged in only two sets, it is also contemplated by the present invention that the connecting sections 19 may so connect the cooling sections 20 that the latter will communicate with one another in series in three, four or more of the above-discussed sets of cooling sections 20. Then, each of the sets of the cooling sections 20 will again be individually connected to the distributing conduit 12 and to the collecting conduit 12*a*, and each of the sets will again define a separate meandering path for the liquid being cooled through the respective heat exchanger unit 2, 2*a* or 2*b* in mutual cross-countercurrent with the advancing cooling air. Under these circumstances, the first of the cooling sections 20 from the left in the uppermost row of the cooling sections 20 will communicate, via its associated connecting section, not with the third cooling section 20 from the left in the same row as discussed above, but rather with the fourth, fifth and so on, cooling section 20 of the same row, and similarly for the remaining cooling sections 20 of the other sets of the cooling sections. Even in this manner, the throughput rate of the liquid to be cooled can be correspondingly increased, and a cooling effect can be achieved in the course of the individual cross-countercurrent flows of the cooling medium through the heat exchanger units 2, 2*a* and 2*b* with respect to the cooling air, which is usually even more uniform than that obtained in the above-discussed two-set interconnection of the cooling sections 20 by the connecting sections 19.

Figure 5:
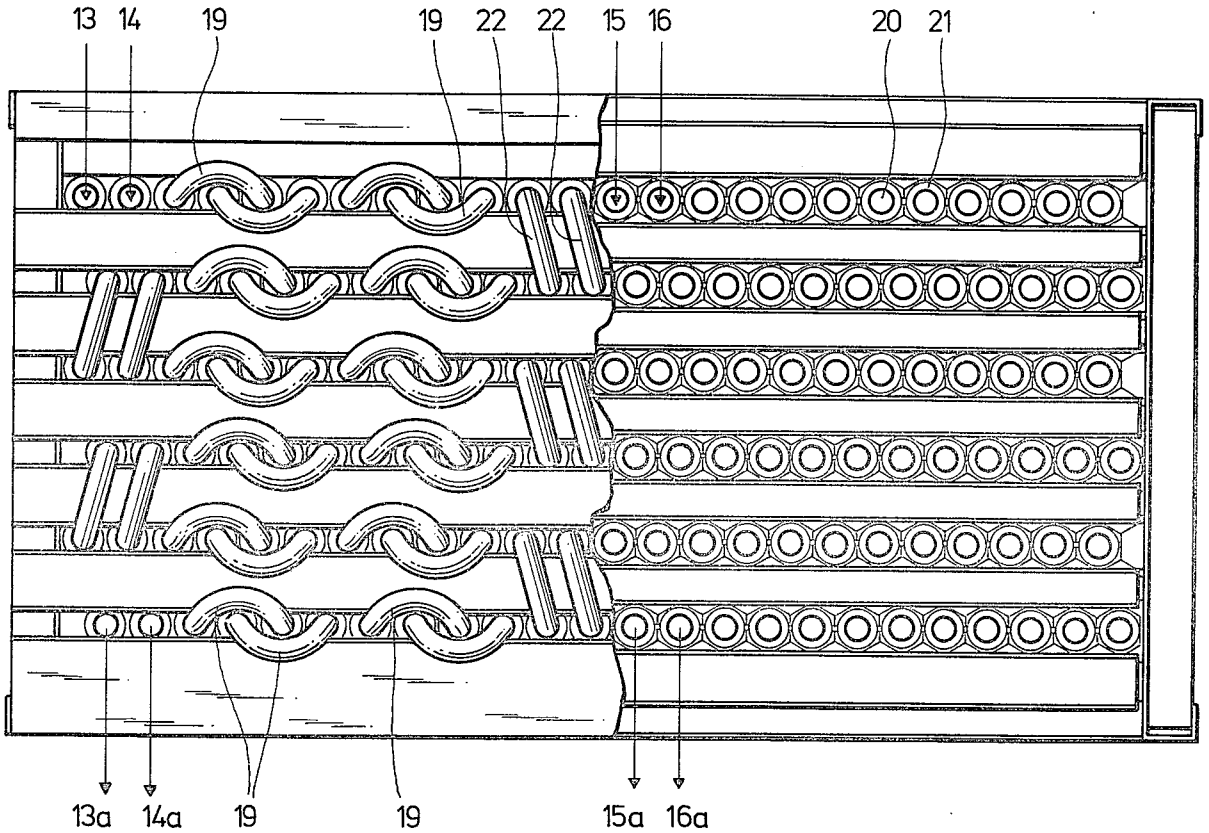
FIG. 5 is a partially broken-away view of two of the heat exchanger units of FIG. 1.

FIG. 5 illustrates a heat exchanger unit which, as to the interconnection of the cooling sections 20 by the connecting sections 19 and 22, corresponds to the situation diagrammatically illustrated in FIG. 3. Thus, the cooling unit of FIG. 5 incorporates six rows of the cooling sections 20 which are superimposed with one another which, while being structurally united in a single heat exchanger unit, are separated in the middle as to their communication into two heat exchanger sub-units. In view of the fact that the heat exchanger unit of FIG. 5 is illustrated as having only two sets of the cooling sections 20, the central subdivision of the illustrated heat exchanger unit into the heat exchanger sub-units is accomplished by providing four inlet branch conduits 13, 14, 15 and 16 for the supply of the liquid to be cooled and with four discharge branch conduits 13*a*, 14*a*, 15*a* and 16*a* for the discharge of the cooled liquid, which are respectively arranged downwardly of the corresponding inlet branch conduits 13, 14, 15 and 16, respectively.

Figure 6:
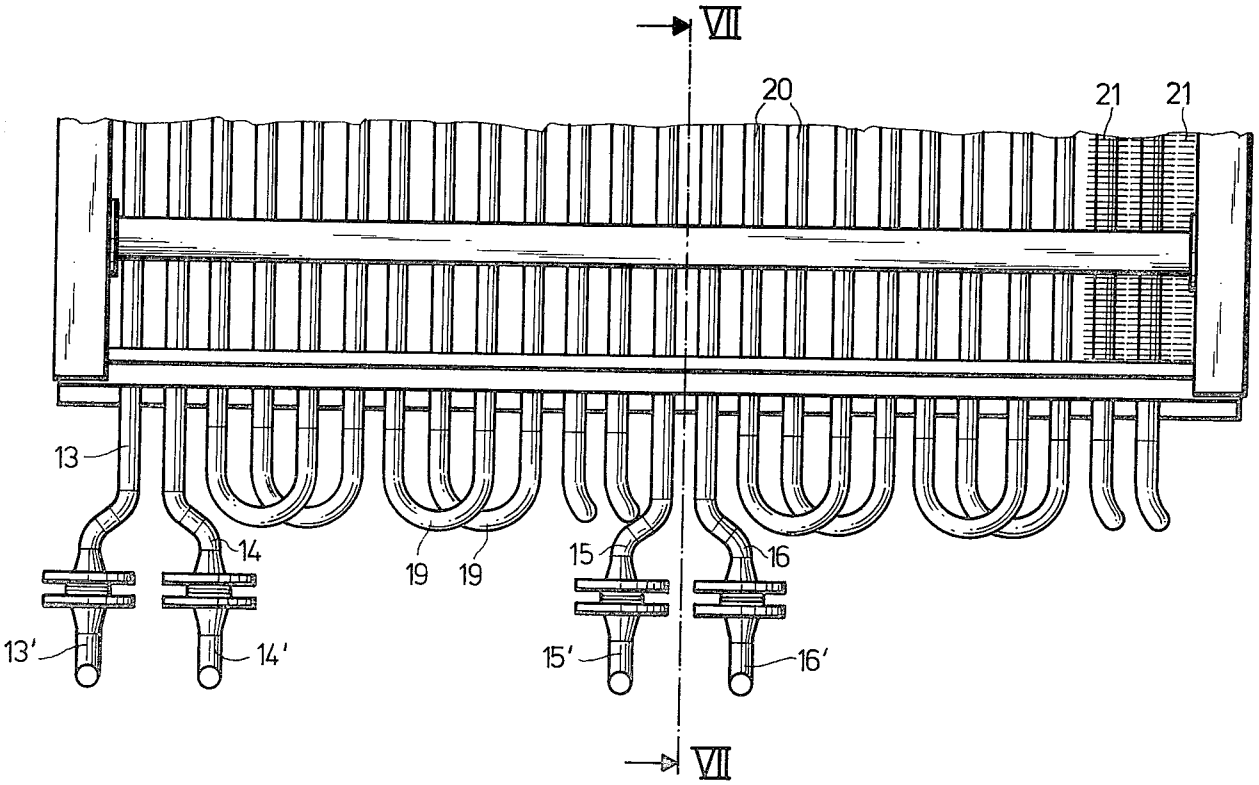
FIG. 6 is a fragmentary top plan view of FIG. 5.
Figure 7:
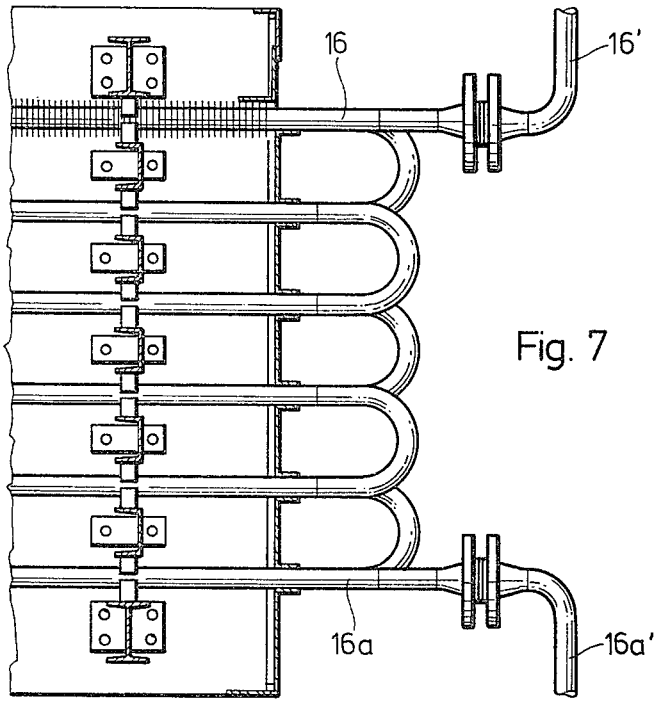
FIG. 7 is a sectional view taken on line VII—VII of FIG. 6.

FIGS. 6 and 7 illustrate the heat exchanger unit of FIG. 5 in a partial top-plan view as well as in a vertical section therethrough. The reference numerals 13', 14', 15' and 16' indicate the respective liquid inlet nipples, while the reference numerals 13*a'*, 14*a'*, 15*a'* and 16*a'* indicate the respective liquid outlet nipples.

Figure 8:
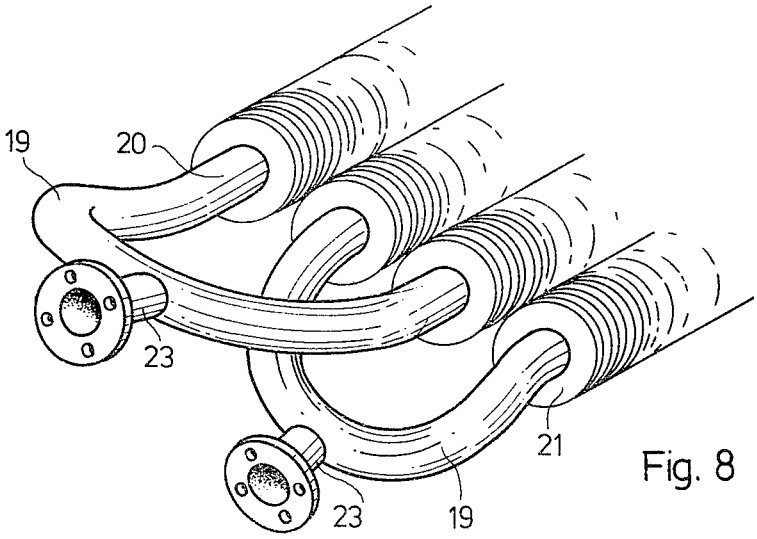
FIG. 8 is a perspective view of a detail of one of the heat exchanger units of FIG. 1.

Finally, it may be seen in FIG. 8 that the cooling sections 20 may be configured as circular tubes and that the above-mentioned ribs or fins 21 can have circular configurations. It may also be seen that the connecting sections 19 may be arcuate tubes which are equipped with cleaning nipples 23 that render it possible to cleanse the interiors of the cooling sections 20 by cleansing brushes or the like in order to remove any deposits therefrom from time to time. Differing from the above-discussed and illustrated exemplary embodiment of the present invention, it is also possible in many instances, especially when the heat exchanger 1 has a relatively small capacity, to arrange the cooling sections 20 substantially vertically rather than horizontally, and to so arrange the blower or the blowers 5 that they propel the cooling air between the substantially vertical cooling sections 20 in the horizontal direction. In all other respects, except for the rear orientation of the cooling sections 20, the features which are characteristic for the present invention remain intact so that the above-discussed advantages of the heat exchanger 1 of the present invention will be utilized to the fullest extent.

It will be understood that each of the elements described above, or two or more together, may also find a useful application in other types of constructions differing from the types described above.

While the invention has been illustrated and described as embodied in an air-cooled heat exchanger for cooling industrial liquids which tend to form deposits at least when the temperature of the liquid being cooled drops below a predetermined level, it is not intended to be limited to the details shown, since various modifications and structural changes may be made without departing in any way from the spirit of the present invention. So, for instance, the inlet and outlet nipples for the two different sets could also be arranged at opposite sides or at opposite ends of the respective heat exchanger unit, or the cooling air could be forced downwardly instead of upwardly in which event the liquid to be cooled would be supplied to the lowermost row of the cooling elements and the cooled liquid withdrawn from the uppermost row.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat exchanger for cooling a liquid in an external stream of cooling gas flowing in a predetermined direction, comprising: a liquid inlet conduit extending at a downstream portion of said external stream and a liquid outlet conduit extending at an upstream portion of said external stream; plural cooling conduit sets including a pair of adjoining cooling conduit connected parallel to each other between said inlet and outlet conduits, each of said cooling conduit sets being shaped into a meander-like configuration and defining straight conduit sections arranged side by side, said plural conduit sets being arranged in at least two rows spaced from one another in said predetermined direction, and each located in a plane transverse to said direction, and further defining connecting conduit sections connecting said straight conduit sections of respective cooling conduits in said pairs in series for providing in each set two parallel flows of the liquid meandering both in a direction counter to and transverse to said predetermined direction.

2. A heat exchanger as defined in claim 1 comprising at least two uniform cooling sets arranged side by side in transverse direction in said external stream.

3. A heat exchanger as defined in claim 1, wherein said connecting sections so communicate said cooling sections within each of said sets that the liquid flows in each of said rows and between said rows in constantly changing directions and in a mutual cross-countercurrent.

4. A heat exchanger as defined in claim 3, wherein said cooling sections in each respective of said rows are spaced a predetermined distance from one another in the plane of said respective row; and wherein said connecting sections which communicate the adjacent ones of said cooling sections of different ones of said sets in said respective row are juxtaposed with each other and offset with respect to one another along said respective row substantially by at least one said predetermined distance.

5. A heat exchanger as defined in claim 4, wherein said connecting sections of said different sets in said respective row overlap one another in space.

6. A heat exchanger as defined in claim 5, wherein said connecting sections are arcuate tubes each having a radius of curvature substantially corresponding to said predetermined distance times one-half the number of said sets.

7. A heat exchanger as defined in claim 5, wherein said connecting sections are tubular connectors each having two connecting portions which are respectively connected to said inlet and outlet ends of said cooling sections; and wherein said two connecting portions of each of said tubular connectors are spaced from one another by said predetermined distance times the number of said sets.

8. A heat exchanger as defined in claim 5, wherein said connecting sections of said different sets bypass one another in space in their respective regions of overlap.

9. A heat exchanger as defined in claim 8, wherein said connecting sections are arcuate tubes; and wherein said arcuate tubes of said different sets are curved in opposite directions with respect to the plane of said respective row to bypass each other at said overlap regions.

10. A heat exchanger as defined in claim 4, wherein said connecting sections which communicate those of said cooling sections of said sets which are arranged in different of said rows are curved and have a radius of curvature which exceeds said predetermined distance.

11. A heat exchanger as defined in claim 10, wherein said cooling sections of each of said sets which are arranged in said different rows are offset with respect to one another transversely of said direction.

12. A heat exchanger as defined in claim 11, wherein the amount of offsetting of said cooling sections arranged in said different rows is substantially one-half said predetermined distance.

13. A heat exchanger as defined in claim 10, wherein said different rows of said cooling sections are spaced apart in said direction by a distance exceeding said predetermined distance.

14. A heat exchanger as defined in claim 3, wherein each of said rows of said cooling sections includes the same number of said cooling sections of each of said sets.

15. A heat exchanger as defined in claim 3, wherein said cooling sections are also arranged in at least two further rows which are spaced from said row, said additional row, and from one another in said direction.

16. A heat exchanger as defined in claim 3, further comprising means for so supporting said sets as to form a cooling unit; and wherein said inlet and outlet conduits include respective inlet and outlet connectors which individually communicate with said cooling sections of said sets.

17. A heat exchanger as defined in claim 3, wherein at least those of said connecting sections which communicate said cooling sections within the respective row of cooling sections have respective cleaning nipples.

18. A heat exchanger as defined in claim 3, and further comprising means for controlling the throughput of said external stream in dependence on the temperature of the cooled liquid.

19. A heat exchanger as defined in claim 18, wherein said external stream is generated in at least one blower and said controlling means includes means for energizing and deenergizing said advancing means.

20. A heat exchanger as defined in claim 19, wherein said blower includes blades which are positionally adjustable toward higher and lower throughputs of said blower; and wherein said controlling means is operative for adjusting the positions of said blades.

* * * * *